United States Patent [19]

Oberstrass

[11] 4,389,841

[45] Jun. 28, 1983

[54] YARN FALSE TWISTING APPARATUS

[75] Inventor: Detley Oberstrass, Tönisheide, Fed. Rep. of Germany

[73] Assignee: Barmag Barmer Maschinenfabrik AG, Remscheid, Fed. Rep. of Germany

[21] Appl. No.: 273,076

[22] Filed: Jun. 12, 1981

[30] Foreign Application Priority Data

Jun. 14, 1980 [DE] Fed. Rep. of Germany ..... 3022421
Jul. 9, 1980 [DE] Fed. Rep. of Germany ..... 3025921

[51] Int. Cl.[3] ..... D02G 1/08

[52] U.S. Cl. ..... 57/340; 57/339; 57/348

[58] Field of Search ..... 57/334–340, 57/348, 349, 104, 105

[56] References Cited

U.S. PATENT DOCUMENTS

| | | | |
|---|---|---|---|
| 2,863,280 | 12/1958 | Ubbelohde | 57/336 X |
| 3,156,084 | 11/1964 | Van Dijk et al. | 57/340 |
| 3,225,533 | 12/1965 | Henshaw | 57/340 X |
| 3,373,554 | 3/1968 | Raschle | 57/340 |
| 3,394,540 | 7/1968 | Bentov | 57/337 X |
| 3,488,941 | 1/1970 | Asaka | 57/340 X |
| 3,495,391 | 2/1970 | Njo | 57/340 |
| 3,994,123 | 11/1976 | Sholly, Jr. | 57/338 X |
| 4,015,414 | 4/1977 | Sholly, Jr. | 57/338 X |
| 4,047,374 | 9/1977 | Venot | 57/338 |
| 4,050,229 | 9/1977 | Hayahusa | 57/340 |
| 4,110,962 | 9/1978 | Schuster et al. | 57/348 X |
| 4,145,871 | 3/1979 | Iwata et al. | 57/340 |
| 4,149,366 | 4/1979 | Bass et al. | 57/339 X |
| 4,240,248 | 12/1980 | Raschle | 57/338 |

FOREIGN PATENT DOCUMENTS

| | | |
|---|---|---|
| 2001120 | 7/1971 | Fed. Rep. of Germany . |
| 2121917 | 8/1971 | France . |
| 1375380 | 11/1974 | United Kingdom . |
| 1421662 | 1/1976 | United Kingdom . |

*Primary Examiner*—John Petrakes
*Attorney, Agent, or Firm*—Bell, Seltzer, Park & Gibson

[57] ABSTRACT

A yarn false twisting apparatus is disclosed which comprises a pair of cooperating friction discs which define a twisting zone between opposed friction surfaces thereof. One of the discs is composed of a thin flexible material, and a pressure applying member is mounted adjacent the back side of the flexible disc for biasing the disc toward the other disc locally at the twisting zone to firmly engage the yarn passing therethrough. The discs are movable with respect to the pressure applying member such that the ratio of twist insertion to yarn speed may be varied. In one illustrated embodiment, the discs are mounted so as to permit selective placement on opposite sides of the pressure applying member and reversal of their direction of rotation, and such that either S twist or Z twist may be imparted, without changing the direction or location of the yarn advance.

27 Claims, 6 Drawing Figures

YARN FALSE TWISTING APPARATUS

The present invention relates to an improved yarn false twisting apparatus, of the type disclosed in commonly owned copending application Ser. No. 168,734, filed July 14, 1980, now U.S. Pat. No. 4,339,915.

In copending application Ser. No. 168,734, there is disclosed an apparatus for false twisting a yarn which comprises a thin flexible or pliable disc mounted for rotation with a cooperating disc or roller to define a twisting zone between opposing friction surfaces thereof. A pressure applying member is mounted adjacent the back face of the pliable disc for biasing the disc toward the other member locally at the twisting zone so as to firmly engage the yarn passing through the twisting zone, and while the friction surfaces remain in substantially non-contacting relationship with respect to each other. As a result, the yarn contacts the friction surfaces only in the narrowly limited and defined twisting zone. One particular advantage of this prior false twisting apparatus is the fact that the apparatus not only twists the yarn, but also effects its conveyance through the twisting zone.

It is an object of the present invention to further develop the friction false twisting apparatus according to the prior patent application such that the ratio of twist to yarn conveyance speed may be selectively varied, without any significant operative effort and without changing the pressure applying member or the yarn path of travel.

It is also an object of the present invention to provide a false twisting apparatus of the described type which is characterized by the ability to readily change from S to Z twist and vice versa.

These and other objects and advantages of the present invention are achieved in the embodiments illustrated herein by the provision of a false twisting apparatus which includes a pair of twist imparting circular discs and which are mounted in opposing relationship and define a twisting zone therebetween. At least one of the dics is relatively thin and flexible, and each of the discs is mounted for movement along a path of travel which extends in a direction generally perpendicular to its axis of rotation and generally parallel to a line which is tangent to the disc at a point immediately adjacent the twisting zone when the disc is disposed at a midpoint along its path of travel. A pressure applying member is mounted at a fixed location, and so as to locally bias the flexible disc toward the other disc at the twisting zone. By this arrangement, it is readily possible to change the ratio of twist insertion to yarn speed, and in doing so, the twist is imparted independently of the twist insertion-speed ratio on essentially the same disc circumference and therefore at essentially constant circumferential speed of the disc.

In one illustrated embodiment of the invention, each of the discs is mounted for pivotal movement on a rocking arm, with each arm being mounted to the frame for pivotal movement about a common axis which is parallel to the axes of rotation of the discs and passes through the twisting zone. Thus, the apparatus can be changed from S to Z twist, and vice versa, by movement of the rocking arms, and without the need to reposition the pressure applying member. Also, the spacing between the yarn admitting guide preceding the friction false twisting apparatus and the twisting zone need not be changed when the twist is changed between S and Z.

Means are also provided for reversing the rotary direction of the two discs, with such reversing means being of simplified construction. Further, it should be noted that conventional mechanical means may be provided to synchronize the repositioning of the two rocking arms in such a manner that, when one is set, the other automatically assumes a symmetrical position to the thread line.

Some of the objects and advantages of the invention having been stated, others will appear as the description proceeds, when taken in connection with the accompanying drawings, in which—

Figure 3A:
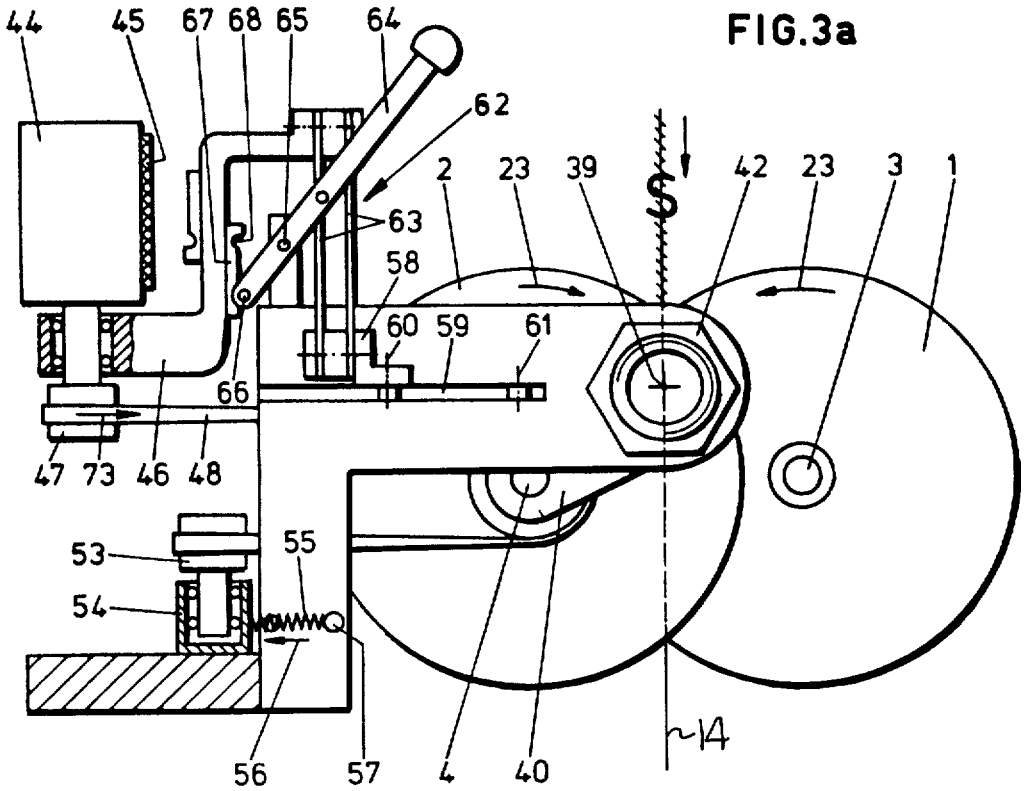
Figure 3B:
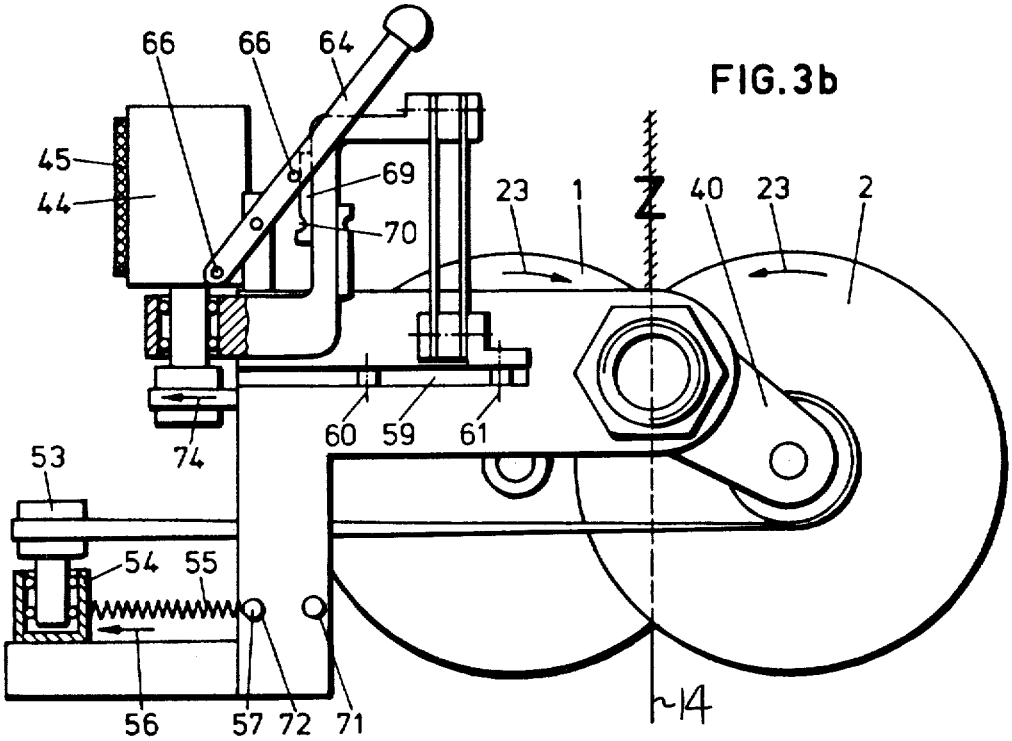
Figure 4:
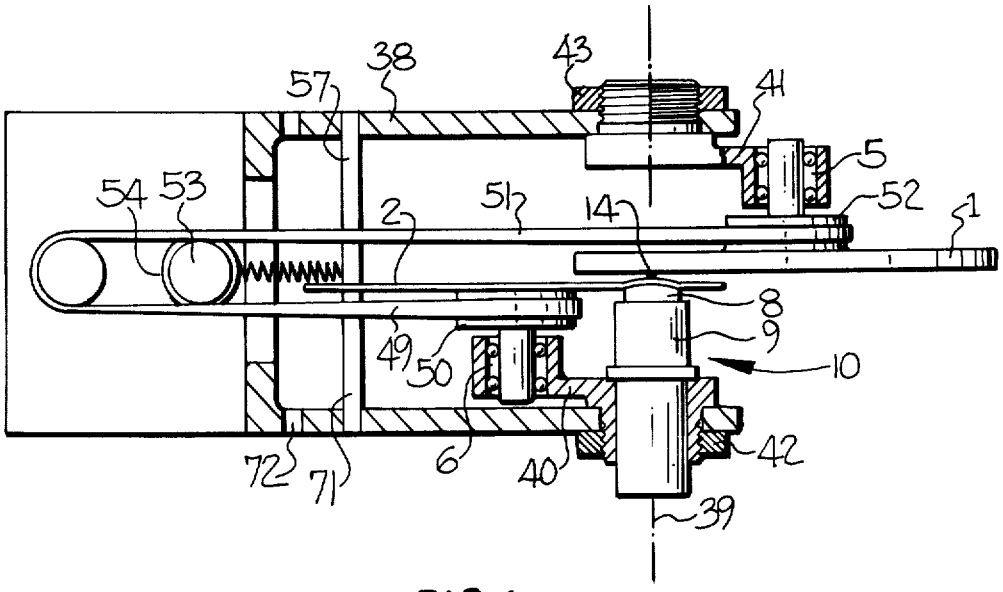
Figure 5:
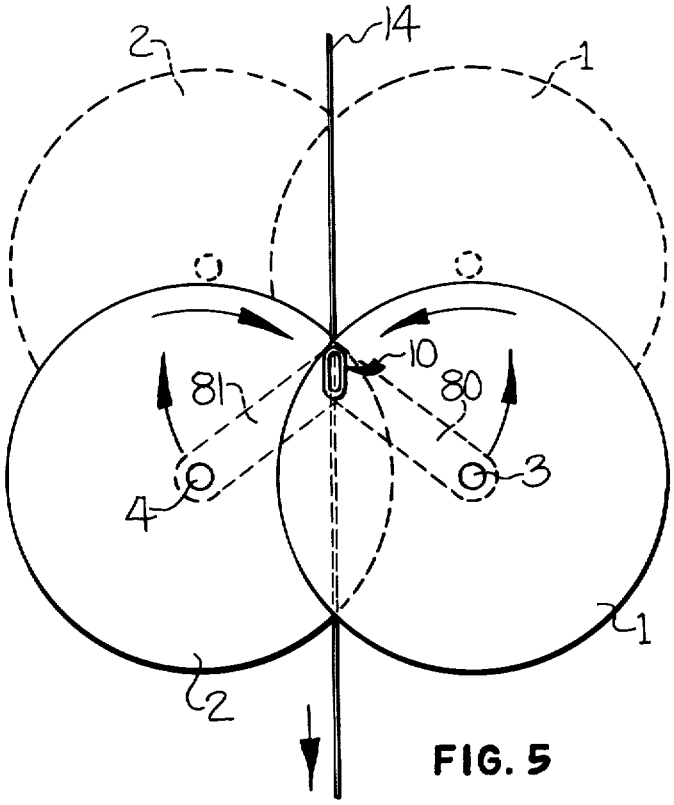

FIG. 3*a* is a side elevation view of a second embodiment of a frictional false twisting apparatus in accordance with the present invention, and which is oriented to apply an S twist to the yarn;

FIG. 3*b* is a view similar to FIG. 3*a*, but with the apparatus being oriented to impart a Z twist;

FIG. 4 is a sectional top plan view of the apparatus shown in FIG. 3*a*; and FIG. 5 is a schematic top plan view of a further embodiment of the present invention, and which is adapted to be readily converted for imparting either S or Z twist to the yarn.

Figure 1:
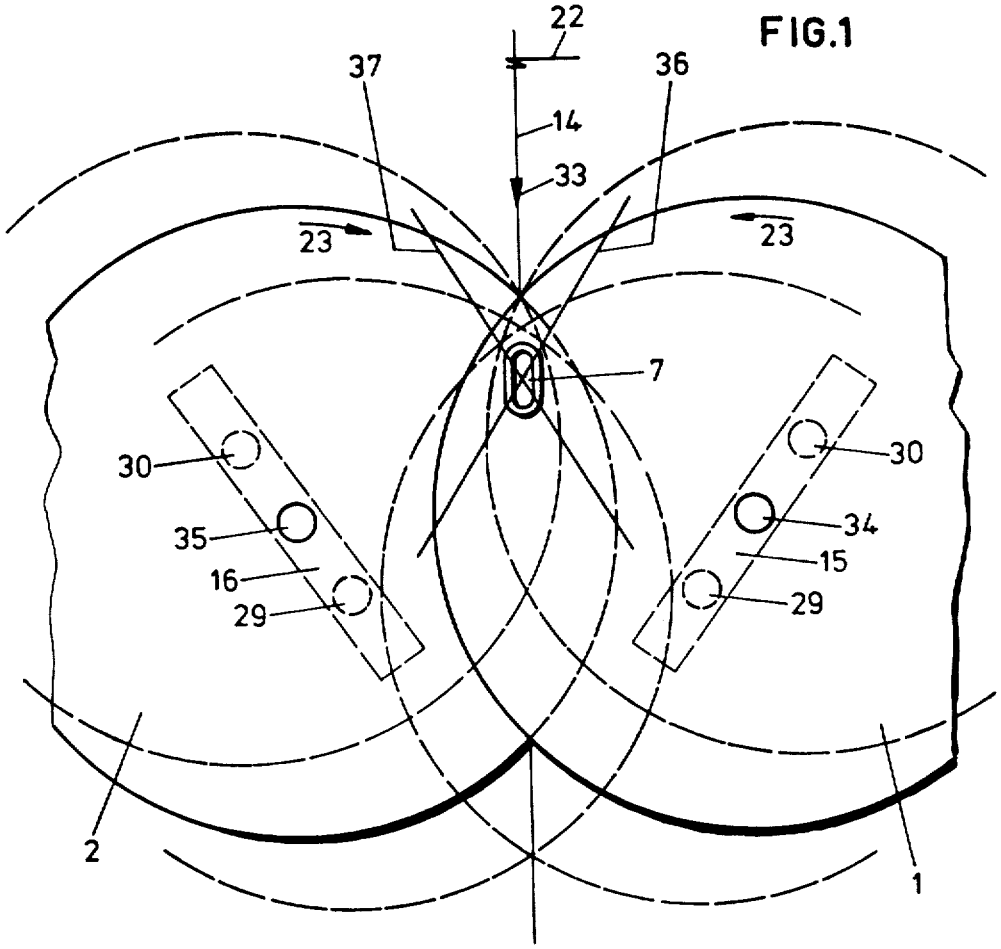
FIG. 1 is a top plan view of a friction false twisting apparatus embodying the present invention and wherein the yarn path extends in a direction perpendicular to the plane which is common to both axes of rotation of the two discs.
Figure 2:
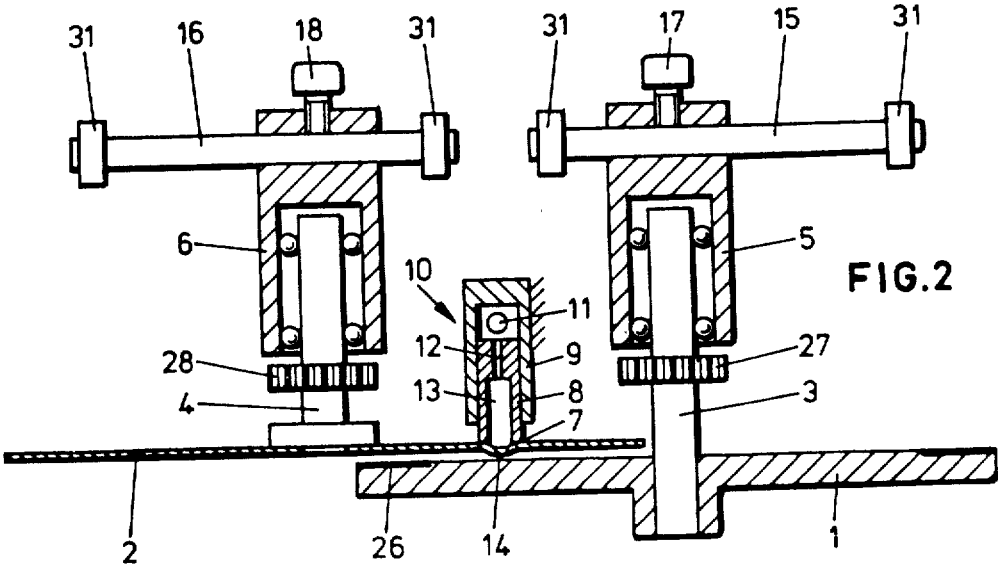
FIG. 2 is a fragmentary sectional side elevation view of the apparatus shown in FIG. 1.

The friction false twist apparatus illustrated in FIGS. 1 and 2 consists of a rigid disc 1 and a flexible disc 2. Both discs are supported on the shafts 3 and 4 which in turn are rotatably mounted in the bearing housings 5 and 6. The discs are driven by drives not shown in these figures, through pulleys 27 and 28, with the direction of rotation being indicated by the arrows 23. The rigid disc is preferably provided with a friction coating 26 which can be rubber, Vulkollan, a wear resistant metal, a plasma coating, a ceramic coating, a nickel-diamond coating, and the like.

The flexible disc 2 consists of a material or a compound material which absorbs the tensile forces caused by centrifugal forces, which at the same time, however, can be easily laterally deflected or upset. The disc can be, for example, a rubber disc having a thickness of 0.5 to 2 mm, which has a cord thread inserted in its rubber layer to increase its tensile strength.

The pressure applying member 10 acts upon the back face of the flexible disc 2 by the pressure surface 7 so that the flexible disc is upset in a direction toward the yarn 14. Thus, the yarn is clamped between the flexible disc 2 and the annular friction surface 26 of the rigid disc 1. The pressure applying member consists of a cylinder 9 and a piston 8 moving therein, which piston has a hollow cavity 13 on its pressure surface 7 facing the flexible disc 2. There is also provided a pressurized air connection 11 by means of which the piston is pressed toward the flexible disc, and in addition, pressurized air is forced into the cavity 13. By this arrangement a pneumatic lubrication is provided between the pressure surface 7 and the flexible disc. Further details concerning the pressure applying member 10 may be obtained from the above referenced copending application.

In FIG. 1, the yarn 14 is fed to the friction false twist apparatus via the thread-admitting guide 22 in a direction perpendicular to the plane which is common to the two axes of rotation of the discs 1 and 2. Accordingly, the oblong pressure surface 7 extends along the yarn path in a direction perpendicular to the common plane of the shafts 3, 4 and thus parallel to the yarn path.

In accordance with the present invention, bearing housings 5 and 6 can each be displaced, whereas the pressure applying member 10 is stationary with respect to the frame of the apparatus. For their displacement, the housings 5 and 6 are provided with guide openings, by which they can be slidably mounted on the slide rods 15, 16. The rods 15, 16 are preferably rectangular in cross section and are positioned symmetrically on opposite sides of the yarn path. The housings are secured by the locking screws 17 and 18. Thus, the discs are movable between the inner extreme positions 29 and the outer extreme positions 30 shown in FIG. 1. The displacement path extends between the stops 31. The housings are positioned such that the two shafts or axes of rotation have the same distance from the thread line.

Slide rod 15 extends in a direction generally perpendicular to the axis of rotation of the shaft 3 and parallel to a line which is tangent to the disc at a point immediately adjacent the twisting zone when the disc is disposed at a midpoint along its path of travel, i.e., at position 34. Thus as seen in FIG. 1, the rod 15 is parallel to the line 36, which line in turn is parallel to the defined tangent. Similarly, the rod 16 extends in a direction parallel to the line 37. This arrangement makes it possible to displace with a technically sufficient accuracy the housings 5 and 6 between the extreme operational positions 29 and 30, without the circumferential speeds of the discs in the thread clamping zone changing significantly. As will be apparent, displacement of the discs between the positions 29 and 30, results in the ratio of twist to yarn conveyance speed being changed, with insertion of an S twist. It should also be noted that any intermediate operational position that is advantageous for the desired false twist method can be chosen between the extreme positions 29 and 30 of the discs.

FIGS. 3*a*, 3*b* and 4 illustrate a second embodiment of the present false twisting apparatus. An S twist is imparted to the yarn with the friction discs 1 and 2 positioned as per FIGS. 3*a* and 4, and a Z twist is imparted with the friction discs 1 and 2 positioned as per FIG. 3*b*. The friction false twisting apparatus shown in these figures includes the bracket 38, which is U-shaped in its transverse section to define two parallel upper and lower arms as seen in FIG. 4. The arms define a central axis 39 extending transversely therebetween, and the lower arm of the bracket mounts the pressure applying member 10 which consists of cylinder 9 and piston 8. The member 10 is aligned with the central axis 39.

Rocking arms 40 and 41 are pivotally supported between the arms of the bracket 38 in a coaxial relationship on the axis 39. The arms 40, 41 are secured in a selected rotational position by nuts 42 and 43. The housings 5 and 6 for the discs 1 and 2 are positioned in the ends of the rocking arms.

The friction false twisting apparatus is driven by tangential belt 45, which extends in a longitudinal direction along the apparatus and runs at a constant speed and in one direction. The tangential belt 45 is in contact with the main whorl 44 of the friction false twist apparatus, which is rotatably mounted in the whorl support member 46, and carries on its shaft a drive pulley 47. The pulley 47 is looped about 180 degrees by th endless belt 48, which then winds around belt pulley 50 of the friction disc 2 with the segment 49, and around belt pulley 52 of the friction disc 1 with the segment 51. The belt 48 also loops about the freely rotatable idler or reversing pulley 53. The mounting 54 of the pulley 53 is movable in the belt tensioning direction 56 and is pressed in the tensioning direction by the pressure spring 55. The pressure spring is mounted to the frame by bolt 57.

The whorl support member 46 is mounted on the guide plate 59 of the bracket 38 in two positions 60 and 61, by means of a connection piece 58. The whorl support member 46 is connected to the connection piece 58 by a parallelogram leaf spring 62. This spring consists of two parallel spring plates 63, whose ends are firmly fixed to each other so that the spring plates 63 can carry out only a parallel movement, upon leaving their rest position. Lever 64 is pivotally mounted at the pivot pin 65 to the bracket 38. Upon pivotal movement of the lever 64, the bolt 66 at the end thereof slides on a slide piece 67 to notch 68. In the position shown in FIG. 3*a*, whorl 44 is pressed against the tangential belt 45 by the force of the parallelogram spring 62. When bolt 66 moves into the notch 68 by a pivotal movement of the lever 64, whorl 44 is separated from the tangential belt 45.

When the whorl support member 46 is moved to the mounting position 61 as illustrated in FIG. 3*b*, another slide piece 69 having a notch 70 is brought into operative position. For separating whorl 44 from the tangential belt, i.e., for interrupting operation of the friction false twising apparatus, bolt 66 is inserted into the eye on lever 64, which eye is adjacent the slide piece 69. Thus when the lever 64 is depressed, the bolt 66 is moved into the notch 70, to disengage the whorl 44 from the belt 45. In order to maintain the tension of belt 48 constant, the fastening point for the pressure spring 55 can be varied. Thus upon switching the whorl support member from position 60 to position 61, the bolt 57 is moved from the eye 71 in the bracket 38 and inserted into the eye 72.

It is preferable that the pressure spring 55 have a very level characteristic, so that the force exerted by the spring in independent of the spring travel within the limits given by the operational positions.

The operation of the friction false twist apparatus illustrated in FIGS. 3 and 4 will now be described. With the friction discs positioned as shown in FIG. 3*a*, the yarn receives an S twist. Thus, the twisting zone, i.e., the zone determined by the pressure applying member, and at which the thread is in frictional contact with the friction discs, can be kept stationary. However, the twisting zone can also be displaced relative to the discs by changing the angular position of the rocking arms 40 and 41 with respect to each other. In order to switch the twist formation from S twist to Z twist, the position of the discs is changed such that disc 2 lies to the right and disc 1 to the left of the yarn path as shown in FIG. 3*b*. Simultaneously, the whorl 44 is moved from its position on the left side of the tangential belt 45 as shown in FIG. 3*a* to the position on the right side of the tangential belt as illustrated in FIG. 3*b*, without the direction of run of the belt being changed.

For the displacement of the whorl 44, the connection piece 58 is moved from position 60 into position 61. To further interrupt operation of the false twist apparatus by separating the whorl from the tangential belt, bolt 66 in lever 64 is shifted from that eye which is in work engagement with slide piece 67 and notch 68, to the eye in engagement with slide piece 69 and notch 70.

Due to the displacement of the whorl, the direction of run of the endless belt 48 is changed from the direction 73 to direction 74 as shown in FIG. 3*b* so that the rotary direction fo the discs 1 and 2 also changes. For maintaining the belt tension, the bolt 57 of the pressure spring 55 is concurrently removed from the eye 71 and inserted into eye 72. The yarn then receives a Z twist. To return to an S twist, the above procedure is reversed.

FIG. 5 schematically illustrates a further embodiment of the present invention and which may be readily converted from S to Z twist or vice versa. In this embodiment, the shafts 3 and 4 of the discs 1 and 2 are rotatably mounted to the rocking arms 80 and 81 respectively. The rocking arms 80, 81 are also pivotally mounted about a common central axis defined by the pressure applying member 10. The discs are rotatable by suitable drive means not shown in this figure, for rotation in opposite directions, and a yarn is adpated to be advanced along a path of travel through the twisting zone at 10 in a direction perpendicular to the plane defined by the axes of rotation of the discs so as to have twist imparted thereto in the manner described above.

In a first position of the discs 1 and 2 as seen in solid lines in FIG. 5, the axes of rotation are disposed on opposite sides of and below the twisting zone at 10. By pivoting the arms 80, 81 in the indicated direction, the discs 1 and 2 may be moved along a direction generally parallel to the direction of the yarn path of travel and to a second position as seen in dashed lines wherein each axis is disposed above the twisting zone and on the same side thereof as in the first position. Thus by moving the discs between such first and second positions, the apparatus may be converted from S to Z twist or vice versa, without moving the twisting zone (i.e., the member 10), and without changing the yarn path of travel or the direction of rotation of each disc.

In the drawings and specification, there has been set forth preferred embodiments of the invention and although specific terms are employed, they are used in a generic and descriptive sense only and not for purpose of limitation.

That which is claimed is:

1. A yarn false twisting apparatus comprising a frame, a pair of twist imparting circular discs, with each disc including a yarn engaging friction surface, and with at least one of said discs being relatively thin and flexible, means mounting said discs to said frame, with said discs being rotatable about generally parallel spaced apart axes and such that portions of the respective yarn engaging friction surfaces are disposed in opposing, face to face relationship and define a twisting zone therebetween, and including means permitting selective movement of each of said discs along a path of travel which extends in a direction generally perpendicular to its axis of rotation and generally parallel to a line which is tangent to the disc at a point immediately adjacent the twisting zone when the disc is disposed at a midpoint along its path of travel, a pressure applying member fixedly mounted to said frame and so as to locally bias said one flexible disc toward the other disc only at said twisting zone, drive means for rotating each of said discs about their respective axes, and such that a yarn may be continuously advanced through said twisting zone in a direction perpendicular to the plane which includes both axes of rotation of said discs, while having twist imparted thereto by frictional contact between the yarn and the respective opposed friction surfaces resulting from the force exerted by the biasing means, whereby the ratio of twist to yarn speed may be selectively varied by selective movement of said discs with respect to said pressure applying member.

2. The yarn false twisting apparatus as defined in claim 1 wherein said means permitting selective movement of each of said discs includes a shaft mounted to each disc and extending along the axis of rotation thereof, a pair of housings each rotatably receiving one of said shafts, and means mounting each of said housings for movement along said path of travel.

3. The yarn false twisting apparatus as defined in claim 2 wherein said means mounting each of said housings comprises a pair of rods fixedly mounted to said frame, with each rod slidably mounting respective ones of said housings, and with each rod being aligned with said path of travel of the associated disc.

4. The yarn false twisting apparatus as defined in claim 2 wherein said means mounting each of said housings comprises a pair of rocking arms, with each arm mounting respective ones of said housings, and means mounting each of said rocking arms to said frame for pivotal movement about a common axis which is parallel to the axes of rotation of said discs and passes through said twisting zone.

5. The yarn false twisting apparatus as defined in claim 2 wherein said drive means includes means for selectively reversing the direction of rotation of both of said discs.

6. The yarn false twisting apparatus as defined in claim 5 wherein said means for selectively reversing the direction of rotation comprises a support member, a drive whorl rotatably mounted to said support member and adapted to be rotatably driven by contact with a tangential belt, drive belt means rotatably interconnecting said drive whorl and each of said shafts of said discs, and means adjustably mounting said support member to said frame for movement between two spaced positions whereby the side of the drive whorl in contact with the tangential belt may be changed, to thereby reverse the direction of rotation of said drive whorl and both of said discs.

7. The yarn false twisting apparatus as defined in claim 6 wherein said drive belt means comprises a drive pulley operatively mounted to said drive whorl, a belt pulley operatively mounted to each of said disc shafts, a tensioning pulley, means resiliently and rotatably mounting said tensioning pulley to said frame, and an endless drive belt operatively disposed for engagement with each of said pulleys.

8. The yarn false twisting apparatus as defined in claim 7 wherein said means mounting said tensioning pulley to said frame includes means for adjustably mounting the same to said frame for movement between two spaced positions, whereby the position of the tensioning pulley may be changed to accommodate the drive belt upon the position of said support bracket being changed.

9. The yarn false twisting apparatus as defined in claim 6 wherein said means adjustably mounting said support member to said frame includes drive release means for moving said support bracket a distance sufficient to disengage said drive whorl from contact with the tangential belt.

10. A yarn false twisting apparatus characterized by the ability to readily change from S to Z twist and vise versa, and comprising a frame including a generally U-shaped bracket having generally parallel, spaced apart arms, and with said arms defining a central axis extending transversely therebetween, a pair of twist imparting circular discs, with each disc including a yarn engaging friction surface, and with at least one of said discs being relatively thin and flexible, means mounting said discs between the arms of said bracket, with said discs being rotatable about parallel spaced apart axes which are parallel to said central axis, and such that portions of the respective yarn engaging friction surfaces are disposed in opposing, face to face relationship and define a twisting zone therebetween which is aligned with said central axis, said mounting means including a shaft mounted to each disc and extending along its axis of rotation, a rocking arm pivotally mounted to each arm of said bracket for selective pivotal movement about said central axis, and means rotatably mounting said disc shafts to respective ones of said rocking arms, whereby the discs may be selectively moved about said central axis between a first relative position wherein the axes of rotation of the discs are disposed on opposite sides of said central axis and a second relative position wherein the axes are each disposed on the other side of said central axes, a pressure applying member fixedly mounted to said bracket in alignment with said central axis and so as to locally bias said one flexible disc toward the other disc only at said twisting zone, drive means for rotating each of said discs about their respective axes in a first rotational direction when the same are located in said first relative position such that S twist may be imparted to a yarn advancing through said twisting zone, and for rotating each of said discs in the opposite rotational direction when the same are located in said second relative position such that Z twist may be imparted to a yarn advancing through said twisting zone.

11. A yarn false twisting apparatus comprising a pair of twist imparting circular discs, with each disc including a yarn engaging friction surface, means mounting said discs with said discs being rotatable about generally parallel spaced apart axes and such that portions of the respective yarn engaging friction surfaces are disposed in opposing, face to face relationship and define a twisting zone therebetween, and including means permitting selective movement of each of said discs along a path of travel which extends in a direction generally perpendicular to its axis of rotation and generally parallel to a line which is tangent to the disc at a point immediately adjacent the twisting zone when the disc is disposed at a midpoint along its path of travel, means for locally biasing one disc toward the other disc at said twisting zone, drive means for rotating each of said discs about their respective axes, and such that a yarn may be continuously advanced through said twisting zone in a direction perpendicular to the plane which includes both axes of rotation of said discs, while having twist imparted thereto by frictional contact between the yarn and the respective opposed friction surfaces resulting from the force exerted by the biasing means, whereby the ratio of twist to yarn speed may be selectively varied by selective movement of said discs with respect to said pressure applying member.

12. A yarn false twisting apparatus characterized by the ability to readily change from S to Z twist and vice versa, and comprising a frame defining a central axis, a pair of twist imparting circular discs, with each disc including a yarn engaging friction surface, means mounting said discs with said discs being rotatable about parallel spaced apart axes which are parallel to said central axis, and such that portions of the respective yarn engaging friction surfaces are disposed in opposing, face to face relationship and define a twisting zone therebetween which is aligned with said central axis, said mounting means including a shaft mounted to each disc and extending along its axis of rotation, a pair of rocking arms pivotally mounted to said frame for selective pivotal movement about said central aixs, and means rotatably mounting said disc shafts to respective ones of said rocking arms, whereby the discs may be selectively moved about said central axis between a first relative position wherein the axes of rotation of the discs are disposed on opposite sides of said central axis and a second relative position wherein each axis is disposed on the opposite side of said central axis from its position in said first relative position, means for biasing one disc against the other disc at said twisting zone, drive means for rotating each of said discs about their respective axes in a first rotational direction when the same are located in said first relative position such that S twist may be imparted to a yarn advancing through said twisting zone, and for rotating each of said discs in the opposite rotational direction when the same are located in said second relative position such that Z twist may be imparted to a yarn advancing through said twisting zone.

13. The yarn false twisting apparatus as defined in claim 12 wherein said drive means for rotating each of said discs comprises a support member, a drive whorl rotatably mounted to said support member and adapted to be rotatably driven by contact with a tangential belt, drive belt means rotatably interconnecting said drive whorl and each of said shafts of said discs, and means adjustably mounting said support member to said frame for movement between two spaced positions whereby the side of the drive whorl in contact with the tangential belt may be changed, to thereby reverse the direction of rotation of said drive whorl and both of said discs.

14. The yarn false twisting apparatus as defined in claim 13 wherein said drive belt means comprises a drive pulley operatively mounted to said drive whorl, a belt pulley operatively mounted to each of said disc shafts, a tensioning pulley, means resiliently and rotatably mounting said tensioning pulley to said frame, and an endless drive belt operatively disposed for engagement with each of said pulleys.

15. The yarn false twisting apparatus as defined in claim 14 wherein said means mounting said tensioning pulley to said frame includes means for adjustably mounting the same to said frame for movement between two spaced positions, whereby the position of the tensioning pulley may be changed to accommodate the drive belt upon the position of said support bracket being changed.

16. The yarn false twisting apparatus as defined in claim 13 wherein said means adjustably mounting said support member to said frame includes drive release means for moving said support bracket a distance sufficient to disengage said drive whorl from contact with the tangential belt.

17. In a yarn false twisting apparatus comprising a frame, a pair of twist imparting circular discs, with each disc including a yarn engaging friction surface, and with at least one of said discs being relatively thin and flexible, a pressure applying member, means mounting said disc and said pressure applying member to said frame, with said discs being rotatable about parallel spaced apart axes and such that portions of the respective yarn engaging friction surfaces are disposed in opposing, face to face relationship and define a twisting zone therebetween, and with said pressure applying member being positioned to locally bias said one flexible disc toward the other disc only at said twisting zone, drive means for rotating each of said discs about their respective axes, and whereby a yarn may be continuously moved through said twisting zone while having twist imparted thereto by frictional contact between the yarn and the respective opposed friction surfaces resulting from the force exerted by said pressure applying member, the improvement wherein said means mounting said discs and pressure applying member to said frame includes means permitting selective relative movement between said discs and said pressure applying member and such that the ratio of twist to yarn speed may be selectively varied.

18. The yarn false twisting apparatus as defined in claim 17 wherein said means mounting said discs and pressure applying member permit such relative movement while maintaining the axes of said discs and said pressure applying member in the form of an isosceles triangle, with the axes of the discs at the base corners of the triangle and the pressure applying member at the apex thereof.

19. In a yarn false twisting apparatus comprising a pair of twist imparting circular discs, with each disc including a yarn engaging friction surface, and with at least one of said discs being relatively thin and flexible, at least one pressure applying member, means mounting said discs and said pressure applying member with said discs being rotatable about parallel spaced apart axes and such that portions of the respective yarn engaging friction surfaces are disposed in opposing, face to face relationship and define a twisting zone therebetween, and with said at least one pressure applying member being positioned to locally bias said at least one flexible disc toward the other disc only at said twisting zone, drive means for rotating each of said discs about their respective axes, and whereby a yarn may be continuously moved through said twisting zone while having twist imparted thereto by frictional contact between the yarn and the respective opposed friction surfaces resulting from the force exerted by said pressure applying member, the improvement wherein said means mounting said discs and pressure applying member includes means permitting selective relative movement between said discs and said pressure applying member within a plane which is substantially parallel to the plane of said friction surfaces of said discs, and such that the ratio of twist to yarn speed may be selectively varied.

20. The yarn false twisting apparatus as defined in claim 19 wherein said means mounting said discs and pressure applying member permit such relative movement such that the axes of said discs and said pressure applying member are maintained at the corners of an isosceles triangle, with the axes of the discs at the base corners of the triangle and the pressure applying member at the apex thereof.

21. A method of false twisting a yarn and characterized by the ability to impart a desired twist angle in the yarn, and comprising the steps of providing a pair of twist imparting circular discs, with each disc including a yarn engaging friction surface, and with at least one of said discs being relatively thin and flexible, and with said discs being rotatable about parallel spaced apart axes and such that portions of the respective yarn engaging friction surfaces are disposed in opposing, face to face relationship and define a twisting zone therebetween, providing a pressure applying member, with said pressure applying member being positioned in locally bias said one flexible disc toward the other disc locally at said twisting zone, rotating each of said discs about their respective axes, while advancing a yarn through said twisting zone so as to have twist imparted thereto by frictional contact between the yarn and the respective opposed friction surfaces resulting from the force exerted by said pressure applying member, and adjustably positioning said discs and pressure applying member relative to each other while maintaining the same in the form of an isosceles triangle, with the axes of the discs at the base corners of the triangle and the pressure applying member at the apex thereof, to achieve a desired twist in the advancing yarn.

22. A method of false twisting a yarn and converting from S to Z twist or vice versa, and comprising the steps of providing a pair of twist imparting circular discs, with each disc including a yarn engaging friction surface, and with at least one of said discs being relatively thin and flexible, and with said discs being rotatable about parallel spaced apart axes and such that portions of the respective yarn engaging friction surfaces are disposed in opposing, face to face relationship, providing a pressure applying member, with said pressure applying member being positioned intermediate said axes of rotation of said discs and so as to locally bias said one flexible disc toward the other disc and thereby define a twisting zone, rotating each of said discs in opposite directions about their respective axes, while advancing a yarn along a path of travel through said twisting zone in a direction perpendicular to said plane defined by the axes of rotation of said discs so as to have twist imparted thereto by frictional contact between the yarn and the respective opposed friction surfaces resulting from the force exerted by said pressure applying member, and then reversing the positioning of said discs such that each axis of rotation is disposed on the opposite side of said pressure applying member from its original position, and reversing the direction of rotation of each disc, to thereby convert from S to Z twist or vice versa without moving the pressure applying member or the yarn path of travel.

23. A yarn false twisting apparatus characterized by the ability to readily convert from S to Z twist or vice versa, and comprising a pair of twist imparting circular discs, with each disc including a yarn engaging friction surface, and with at least one of said discs being relatively thin and flexible, and with said discs being rotatable about parallel spaced apart axes and such that portions of the respective yarn engaging friction surfaces are disposed in opposing, face to face relationship and define a twisting zone therebetween, a pressure applying member, with said pressure applying member being positioned to locally bias said one flexible disc toward the other disc locally at said twisting zone, drive means for rotating each of said discs in opposite directions about their respective axes, and including means for reversing the direction of rotation of both discs, and such that a yarn may be advanced along a path of travel through said twisting zone in a direction perpendicular to said plane defined by the axes of rotation of said discs so as to have twist imparted thereto by frictional contact between the yarn and the respective opposed friction surfaces resulting from the force exerted by said pressure applying member, and means mounting said discs for permitting the discs to be selectively moved between a first relative position wherein the axes of rotation of the discs are disposed on opposite sides of said pressure applying member and a second relative position wherein each axis is disposed on the opposite side of said pressure applying member from its position in said first relative position, to thereby permit conversion from S to Z twist or vice versa without changing the yarn path of travel.

24. A yarn false twisting apparatus characterized by the ability to readily change from S to Z twist and vice versa, and comprising a frame defining a central axis, a pair of twist imparting circular discs, with each disc including a yarn engaging friction surface, means mounting said discs with said discs being rotatable about parallel spaced apart axes which are parallel to said central axis, and such that portions of the respective yarn engaging friction surfaces are disposed in opposing, face to face relationship and define a twisting zone therebetween which is aligned with said central axis, said mounting means including a shaft mounted to each disc and extending along its axis of rotation, a pair of rocking arms pivotally mounted to said frame for selective pivotal movement about said central axis, and means rotatably mounting said disc shafts to respective ones of said rocking arms, whereby the discs may be selectively moved about said central axis between a first relative position wherein the axes of rotation of the discs are disposed on opposite sides of and below said central axis, and a second relative position wherein each axis is disposed above said central axis and on the same side as in said first relative position, drive means for rotating each of said discs about their respective axes in the same rotational direction in each of the first and second relative positions, with the discs rotating in opposite directions relative to each other, whereby a yarn may be advanced along a path of travel through said twisting zone in a direction passing between said axes of rotation in each of the first and second relative positions, with S twist being imparted with the discs positioned in one of the relative positions and Z twist being imparted with the discs positioned in the other relative position.

25. The yarn false twisting apparatus as defined in claim 24 wherein at least one of said discs is relatively thin and flexible, and said apparatus further comprises means for biasing said one flexible disc toward the other disc at said twisting zone.

26. A method of false twisting a yarn and converting from S to Z twist or vice versa, and comprising the steps of providing a pair of twist imparting circular discs, with each disc including a yarn engaging friction surface, and with said discs being rotatable about parallel spaced apart axes and such that portions of the respective yarn engaging friction surfaces are disposed in opposing, face to face relationship, and define a twisting zone therebetween which is positioned on one side of the plane defined by the axes of rotation of said discs, rotating each of said discs in opposite directions about their respective axes, while advancing a yarn along a path of travel through said twisting zone in a direction perpendicular to said plane defined by the axes of rotation of said discs so as to have twist imparted thereto by frictional contact between the yarn and respective opposed friction surfaces, and then moving each of said discs along a direction generally parallel to the direction of the yarn path of travel to a second operative position wherein said twisting zone is positioned on the other side of the plane defined by the axes of rotation of said discs, without changing the direction of rotation of each disc, to thereby convert from S to Z twist or vice versa without moving the twisting zone or the yarn path of travel.

27. The yarn false twisting apparatus as defined in claim 12 wherein said biasing means comprises a receptacle mounted to said frame in alignment with said central axis, and a piston slideably mounted within said receptacle and including a pressure surface facing the adjacent disc.

* * * * *